United States Patent [19]

Honma

[11] Patent Number: 4,640,603

[45] Date of Patent: Feb. 3, 1987

[54] COPYING APPARATUS

[75] Inventor: Toshio Honma, Tokyo, Japan

[73] Assignee: Canon Kabushiki Kaisha, Tokyo, Japan

[21] Appl. No.: 532,144

[22] Filed: Sep. 14, 1983

[30] Foreign Application Priority Data

Sep. 24, 1982 [JP] Japan ..... 164979
Sep. 24, 1982 [JP] Japan ..... 164980

[51] Int. Cl.[4] ..... G03G 15/00

[52] U.S. Cl. ..... 355/3 R; 355/14 E; 355/14 C; 355/14 R; 355/69

[58] Field of Search ..... 355/14 E, 14 CH, 14 R, 355/14 C, 67, 69, 3 R

[56] References Cited

U.S. PATENT DOCUMENTS 2,956,487 10/1960 Giaimo, Jr. ..... 355/140
3,788,739 1/1974 Coriale ..... 355/14 E
4,120,034 10/1978 Fisk et al. ..... 355/14 C
4,306,804 12/1981 Sakamoto et al. ..... 355/14 E
4,341,460 7/1982 Kohyama ..... 355/14 R X
4,344,699 8/1982 McIntosh ..... 355/68 X
4,355,885 10/1982 Nagashima ..... 355/14 CH
4,391,502 7/1983 Nishikawa ..... 355/14 E
4,394,087 7/1983 Irie et al. ..... 355/14 R
4,460,270 7/1984 Watai et al. ..... 355/14 E

*Primary Examiner*—Arthur T. Grimley
*Assistant Examiner*—C. Romano
*Attorney, Agent, or Firm*—Fitzpatrick, Cella, Harper & Scinto

[57] ABSTRACT

A copying apparatus capable of automatically adjusting the image density by reading the average density of the original document and still allowing fine adjustment by the operator for covering minor fluctuation in the image density.

10 Claims, 6 Drawing Figures

COPYING APPARATUS

BACKGROUND OF THE INVENTION

1. Field of the Invention

The present invention relates to a copying apparatus capable of detecting the density of an original document and controlling the image forming conditions according to the result of said detection.

2. Description of the Prior Art

The density control in a conventional copier has generally been achieved by a manual continuous control lever for example movable within a range from "F1" to "F9", or by a stepwise selector means suitably positioned for example at "dark", "medium" or "light".

In such manual density control, if an original with a relatively dark background, for example newspaper, diazo copy or original printed on colored paper, is copied with the density control adjusted at the standard density, there will be obtained a copy with so-called background fog, in which the background color of the original is reproduced in the same color as that of the reproduced image so that the entire copy looks smeared. On the other hand, in the case of an original with an extremely low image density, for example an original with a hard pencil, the image may not be faithfully reproduced on the copy.

In order to prevent such phenomena, the operator is required to adjust the density control lever to a position "F8" to "F9" or the selector to a position "light" in the former case, or to adjust the density control lever to a position "F3" or "F4" or the selector to a position "dark" in the latter case, in anticipation of the result.

FIG. 1 shows the conventional manual density control device, composed of a density control variable resistor 1 and a copy density scale 2, wherein "1" indicates a dark image density used in case of obtaining a higher image density from a low density original, such as one written with a hard pencil. A position "9" indicates a light image density, utilized for copying an original with colored background, for example newspaper or diazo copy, without reproducing said background color. A position "5" corresponds to a normal image density. Thus the operator has been required to suitably adjust the density control variable resistor 1 within the range from "1" to "9", according to the original document to be copied.

In such operation, however, an optimum copy can only be obtained when the operator has become used to the original after making plural copies from the same original, so that unnecessary waste copies have been unavoidable because of inadequate density control for an original newly encountered.

In order to avoid such inconvenience there is already developed a copying apparatus with automatic density controlling function. Such copier is designed to adjust the image density automatically by reading the density of the original document and accordingly adjusting the exposure or the image development.

Such density control would become ideal if the background color of the original can be detected. In practice, however, detection is generally made on the average density of the original since the measurement of background color of various originals is extremely difficult. Consequently such automatic density control is still unable to cover all the originals and results in waste copies. Furthermore the density level determined by the copier may be different from what is desired by the user. Because of such factors manual density control may still be required in the copier with the automatic density control function.

SUMMARY OF THE INVENTION

In consideration of the foregoing, an object of the present invention is to provide a copying apparatus capable of optimum image formation corresponding to various originals.

Another object of the present invention is to provide a copying apparatus capable of selecting image forming conditions according to the detection of the original density and still allowing fine adjustment of the thus selected conditions.

Still another object of the present invention is to provide a copying apparatus capable of reading the original density and displaying said original density thus detected.

The foregoing and still other objects of the present invention will become fully apparent from the following description.

DETAILED DESCRIPTION OF THE PREFERRED EMBODIMENTS

Now the present invention will be clarified in detail by embodiments thereof shown in the attached drawings.

Figure 1:
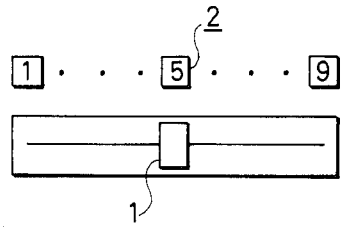
FIG. 1 PRIOR ART
FIG. 1 is a schematic view of a conventional manual density controlling variable resistor.
Figure 2:
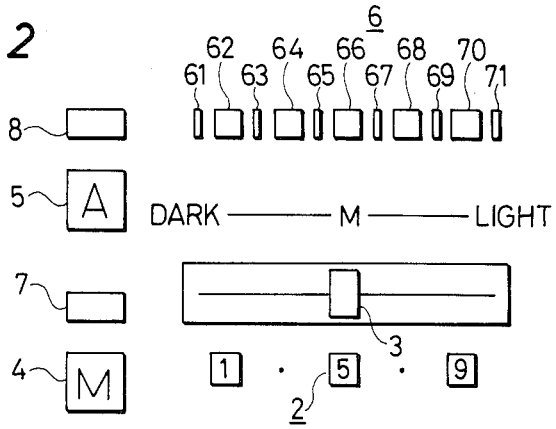
FIG. 2 is a plan view showing an example of an operating unit equipped with a selector switch for an automatic density control mode or a manual density control mode and a density control lever according to the present invention.

FIG. 2 shows an example of a part of the operating panel particularly related to the density control for use in an embodiment of the present invention, wherein a scale 2 indicates the levels of the copy density when it is selected with a manual density control lever in the same manner as explained in relation to FIG. 1. A density control lever 3 selects a copy density corresponding to the density scale 2 when a manual density control switch 4 is selected to adopt the manual control mode. On the other hand, when an automatic density control switch 5 is selected, the density of the original to be measured by a circuit to be explained later is displayed in one of display elements 61–71, for example light emitting diodes, constituting a display unit 6, and the lever 3 is used for fine adjustment of the density within a determined range around the thus indicated original density. Display elements 7 and 8, composed for example of light emitting diodes, are respectively utilized to indicate whether the manual or automatic density control mode is selected by the switch 4 or 5.

Figure 3:
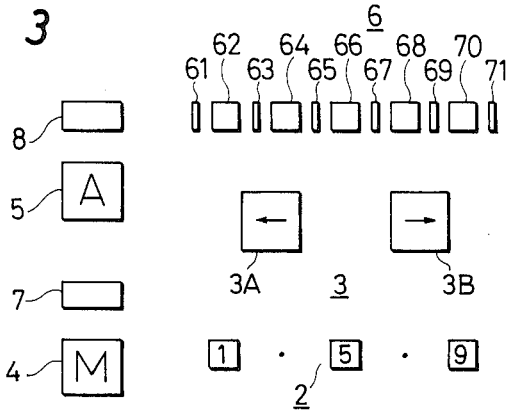
FIG. 3 is a plan view showing another example of an operating unit utilizing density control switches.

FIG. 3 shows another example of the operating panel, wherein the density control lever 3 shown in FIG. 2 is replaced by density control switches 3A and 3B for changing the density respectively to the darker side and to the lighter side, through the regulation of a resistance by a motor, and the display unit 6 is utilized to indicate the selected density. Other components are the same as those in FIG. 2 and will not, therefore, be explained further.

Figure 4:
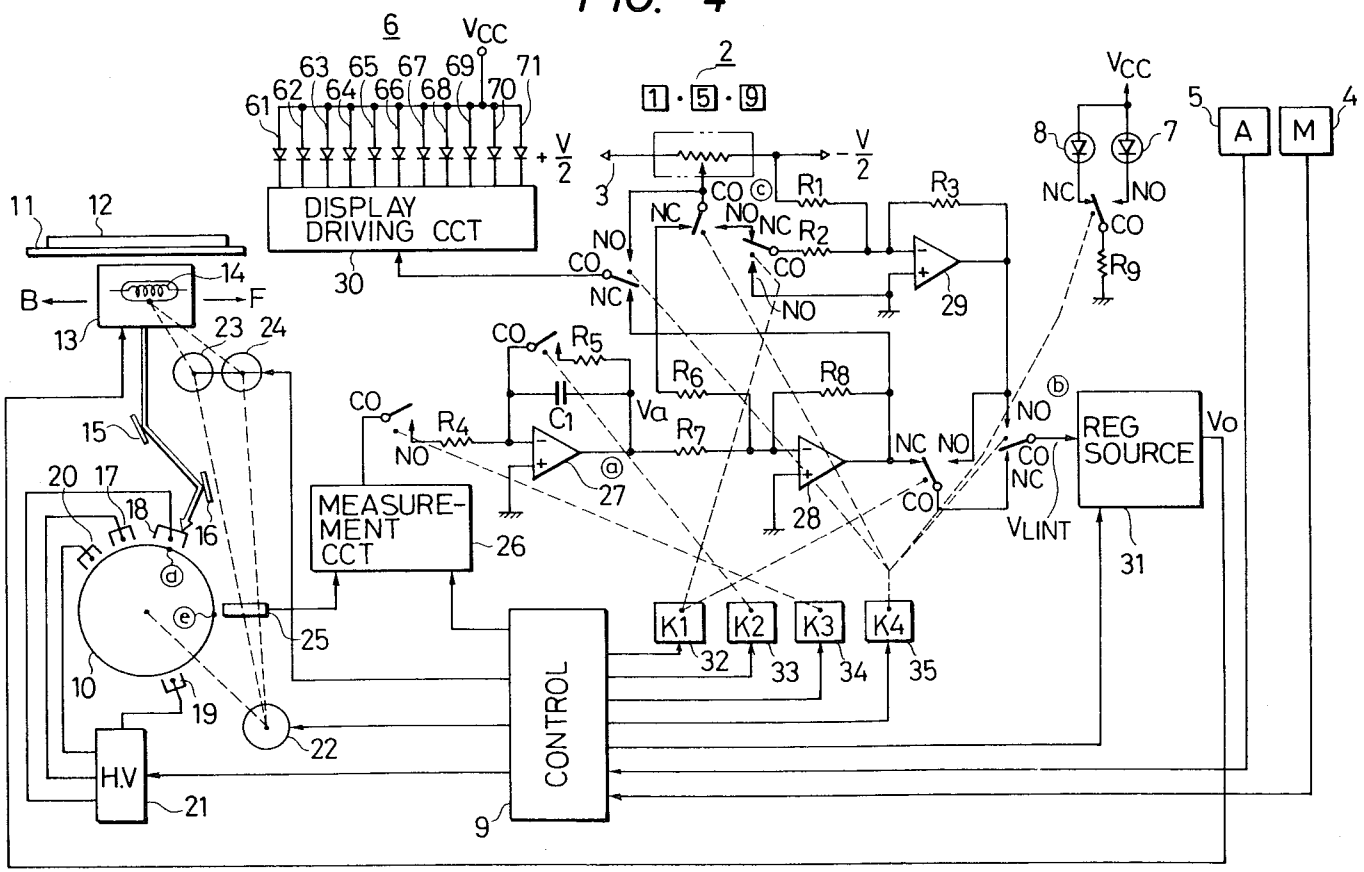
FIG. 4 is a circuit diagram showing a circuit for density control adapted for use in the circuit of the copying apparatus for the present invention.
Figure 5:
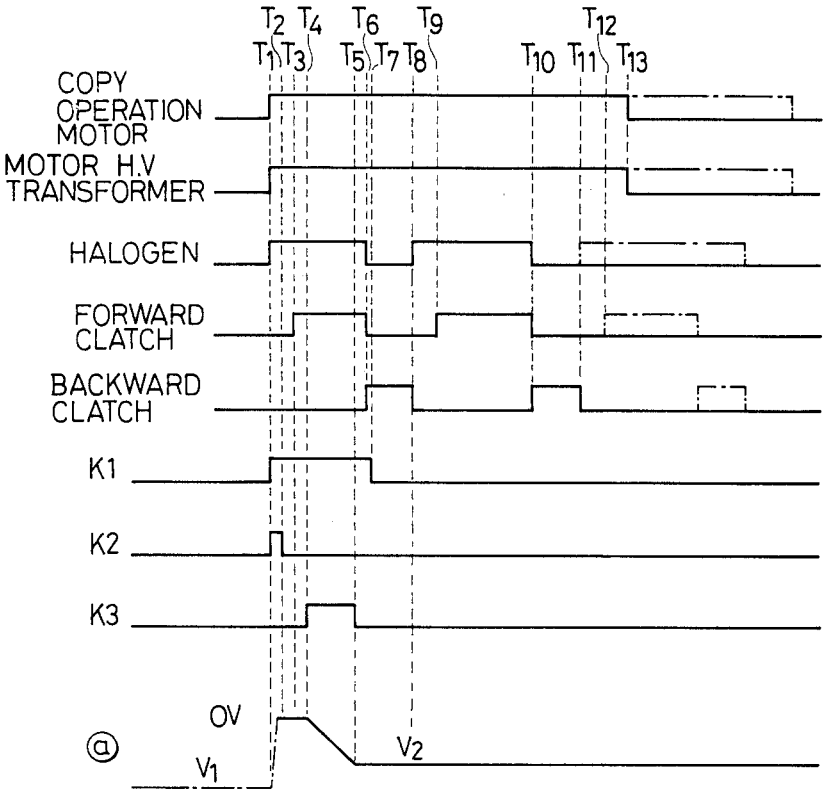
FIG. 5 is a timing chart showing the functions of various components of the circuit shown in FIG. 4.
Figure 6:
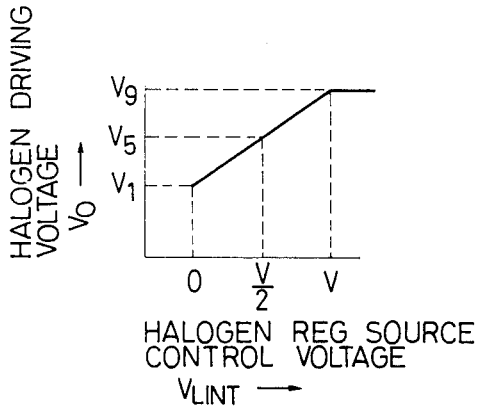
FIG. 6 is a chart with a characteristic curve representing the relationship between the control input voltage to a stabilized power source for the halogen lamp employed in the foregoing embodiments and the halogen lamp lighting voltage.

FIG. 4 is a circuit diagram relating to the density control and adapted for use in the electric circuit of the copier of the present invention, and FIG. 5 is a timing chart indicating the functions of said density control circuit. FIG. 6 is a chart indicating the halogen lamp lighting voltage V0 as a function of a control input voltage $V_{LINT}$ to a voltage regulator for the exposure halogen lamp employed in the present invention.

Prior to the explanation of the function there will be given an explanation on of the structure of the density control circuit.

In FIG. 4 there is shown a control block 9 for the entire copier, principally composed of an already known one-chip microcomputer. A photosensitive drum 10 is utilized for forming a latent image of an original 12 placed on an original carriage 11. A movable optical unit 13 scans said original 12 with a halogen lamp 14, and guides the reflected light through mirrors 15, 16 to the photosensitive drum 10. Charging units 17, 18, 19, 20 are respectively utilized for primary charging, secondary charging, image transfer charging and preliminary charge elimination. A high-voltage power supply unit 21, for supplying high voltages to said charging units 17–20, is controlled by signals from the control unit 9. There is further shown a motor 22 for driving the photosensitive drum; a clutch 23 for transmitting the motion of said motor 22 to the optical unit 13 for advancing said unit in a forward direction F; a clutch 24 for similarly moving the optical unit 13 in a backward direction B; a probe 25 for measuring the latent image potential on the photosensitive drum 10; and a potential measuring circuit 26 adapted for receiving the latent image potential from said probe 25 at determined timings in response to signals from the control unit 9 and releasing density signals corresponding to the latent image potential.

Also shown are operational amplifiers 27, 28, 29; a circuit block 30 for lighting a display element in the display unit 6 to indicate either the density level selected by the lever 3 in the manual density control mode, or the exposure level determined by the operational amplifier 28 is response to the measurement of the original density in the automatic density control mode; a voltage regulator 31 for the halogen lamp 14 for example with an input-output characteristic shown in FIG. 6; solenoid relays 32, 33, 34, 35; and a resistor R9 for limiting the current to light-emitting diodes 7 and 8.

Now there will be given an explanation on the function of the circuit shown in FIG. 4.

When the operator selects the manual density control mode, the manual density control switch 4 is actuated to indicate said selection to the control unit 9, whereby the mode selecting relay K4 (35) is shifted to a side NO corresponding to the manual density control mode, thus lighting the light-emitting mode 7 and indicating the manual density control mode. Simultaneously an output control terminal of the voltage regulator 31 is connected to the output of the operational amplifier 29. Also the voltage of the sliding contact of the density control variable resistor 3 (point (c)) is connected to the inverted input terminal (−) of the operational amplifier 29 through the contacts NC, CO of the relay K1 (32) and a resistor R2. Consequently the voltage $V_{LINT}$ applied to the control terminal (point (b)) of the voltage regulator 31 varies in a range to be explained in the following. The operational amplifier 29 constitutes an adding circuit with resistors R1, R2 and R3. If the same resistances of said resistors are selected same, there stands a relation:

$$V_{LINT} = -(-V/2 + V_c)$$

wherein $-V/2$ is the input voltage to the resistor R1, $V_c$ is the input voltage to the resistor R2, and $V_{LINT}$ is the output voltage of the operational amplifier 29. Thus, in response to the movement of the density control lever 3 from "1" to "9" for changing the voltage at (c) from $+V/2$ to $-V/2$, the voltage $V_{LINT}$ changes from 0 corresponding to "1", to $+V/2$ corresponding to "5" and further to $+V$ corresponding to "9". Also in response to the above-described change of the voltage $V_{LINT}$ and according to the characteristic of the voltage regulator shown in FIG. 6, the lighting voltage of the halogen lamp varies from V1 to V5 and further to V9 respectively corresponding to the positions "1", "5" and "9", namely, corresponding to the copy density desired by the operator.

Then, in case the automatic density control mode is selected, the operator actuates the automatic density control switch 5 to advise said selection to the control unit 9, whereby the mode selecting relay K4 (35) is shifted to a side NC corresponding to the automatic density control mode, thus lighting the light-emitting diode 8 and indicating the automatic density control mode. Simultaneously the control terminal of the voltage regulator 31 is connected to the output of the operational amplifier 28 through the contacts CO, NC of the relay K1 (32). Also, the voltage of the sliding contact (point (c)) of the density control lever 3 is supplied to the inverted input terminal (−) of the operational amplifier 28 through a resistor R6. When said density control lever 3 is positioned at the standard density "5", the voltage at the point (c) is equal to zero, so that the output of the operational amplifier 28 is determined by the output voltage at point (a) of the operational amplifier 27 to be supplied through a resistor R7.

Now reference is made to the timing chart shown in FIG. 5 for explaining the function in the automatic density control mode. With the start of a copying operation at a timing T1, the motor 22 is activated to rotate the photosensitive drum 10. Simultaneously the high-voltage transformer 21 is activated to supply high voltages to the charging units 17, 18, 19, 20 whereby an electrostatic charge is given to the photosensitive drum 10 according to the known electrophotographic process. At the same time, the halogen lamp 14 is lighted to start the density measurement of the original 12. Then the relay K1 (32) is energized to shift the contact from NC to NO. Simultaneously the control terminal of the voltage regulator 31 is disconnected from the operational amplifier 28 and is connected to the output of the operational amplifier 29 through the contacts CO and NC of the relay K4 (35) and further through the contacts CO and NO of the relay K1 (32). Also, a resistor R2 connected to the inverted input terminal (−) of the operational amplifier 29 is connected to the zero potential through the contacts CO and NO of said relay K1.

The corresponding output can be obtained from the foregoing equation with a condition $V_c=0$, so that:

$$V_{LINT}=-(-V/2+0)=V/2.$$

Said output remains constant while the relay K1 is energized (from T1 to T5 in FIG. 6), so that the output voltage V0 of the voltage regulator 31 is fixed to a value V5, thus providing an exposure the same as that obtained when the density control lever 3 is placed at a position "5". In this manner the light intensity from the halogen lamp 14 becomes always constant during the measurement of the original density.

At said timing T1, the relay K2 (33) is also energized to discharge the voltage $V_a$ in a condenser C1 through a resistor R5, thus resetting a sample holding circuit constituted by a Miller's integrating circuit composed of a resistor R4, said condenser C1, an operational amplifier 27 and the contact of the relay K3. Said resetting is completed by a timing T2, so that the operational amplifier 27 releases a zero output. Then, at a timing T3 when the light intensity from the halogen lamp 14 has become higher, the forward clutch 23 is activated to move the optical unit 13 to the forward direction F. Thus, the light from the original 12 is reflected by the mirrors 15, 16 and introduced to a point (d) on the photosensitive drum 10, thus forming an electrostatic latent image of the original 12. Then the relay K3 (34) is energized at a timing T4 before the electrostatic latent image corresponding to a determined part of the original 12 on the carriage 11 reaches a measuring position (e) of the surface potential sensor 25, and the output of the potential measuring circuit 26 is supplied to the above-mentoned sample holding circuit through the contacts CO, NO of the relay K3 (34). Said sample holding circuit integrates said surface potential with a time constant R4×C1. The relay K3 (34) is deactivated at a timing T5 when the surface potential of the electrostatic latent image is sampled within a determined area in the original 12. Said measuring area of the original density may cover the entire original or may cover only a part thereof. As shown in the timing chart in FIG. 5, the output voltage at a point (a) of the sample holding circuit becomes lower than zero at T3 and reaches V2 at a timing T5. The final voltage at said point (a) is naturally dependent on the average density of the original, and is lower for a darker original.

Upon completion of the sampling of the average density within a determined area in the original 12, the forward clutch 24 is deactivated at a timing T6. Simultaneously the halogen lamp 14 is turned off, and the backward clutch 23 is energized instead to initiate the backward movement of the optical unit 13. The relay K1 (32) is deactivated at a timing T7 immediately after the start of said backward movement, whereby the control terminal of the voltage regulator 31 is connected to the output of the operational amplifier 28 through the contacts CO and NC of the relay K1 (32). Said operational amplifier 28 constitutes an adding circuit in combination with resistors R6, R7 and R8. If said resistors R7, R8 have a resistance R while the resistor R6 has a resistance nR, there is obtained a relation:

$$V_{LINT}=-(V_a+(1/n)V_c)$$

wherein $V_{LINT}$ is the output of the operational amplifier 28, while $V_c$ and $V_a$ are voltages respectively supplied to the resistors R6 and R7. Stated differently, the voltage $V_{LINT}$ in this case is composed of the voltage $V_a$ representing the original density and another voltage $V_c/n$ which is equal to 1/n to the voltage $V_c$ from the density control lever 3. When a newspaper is employed as the original 12 and is copied with the density control lever 3 positioned at "5", and if the sample holding circuit is so designed as to release the output voltage $V_a$ equal to −V, namely, the operational amplifier 27 reaches a state V2=−V at the timing T5, then:

$$V_{LINT}=-(-V+1/n\times 0)=+V$$

since $V_c=0$. As will be understood from FIG. 6, the voltage thus obtained is equal to the case when the density control lever 3 is positioned at "9", whereby the background color of the newspaper can be eliminated. Said voltage is identified by a level identifying circuit block 30 through another contact of the relay K4 (35), whereby the light-emitting diode 65 is lighted. When the optical unit 13 reaches a home position at a timing T8 in this state, the backward clutch 24 is deactivated to terminate the movement of the optical unit 13. Simultaneously the halogen lamp 14 is lighted for initiating the scanning operation for the actual copying. The lighting voltage in this state is equal to a value V9 controlled according to the density measurement in the period from T1 to T8.

When the light intensity of the halogen lamp 14 becomes constant, the forward clutch 23 is again activated at a timing T9 to scan the original 12 until a timing T10 when said forward clutch 23 and the halogen lamp 14 are deactivated while the backward clutch 24 is activated. Said backward clutch 24 is deactivated at a timing T11 when the optical unit 13 reaches the home position. In the case of making plural copies from a same original, the halogen lamp 14 is lighted at said timing T11 and the forward clutch 23 is activated again at a timing T12 to repeat the procedure from T8 to T11. At the final copying or in the single copying mode, the halogen lamp 14 remains turned off at the timing T11 and the motor 22 and the high-voltage transformer 22 are turned off at the timing T13 to terminate the copying operation.

As explained in the foregoing, in the automatic density control mode, data proportional to the average original density are obtained in a preliminary scanning of the optical unit, maintained in a sample holding circuit and displayed on the display unit 6, and the succeeding copy cycle is conducted with a light intensity of the halogen lamp 14 corresponding to said data. In case the operator desires a certain change from the density level determined by the automatic density control, the density control lever 3 can be shifted from the standard position "5" toward the position "1" for a darker density or "9" for a lighter density, whereby a density change corresponding to V/n is rendered possible. In this manner the operator can make a certain density change with the density control lever around the density level corresponding to the original density displayed on the display unit 6.

The foregoing embodiment is so constructed as to detect the original density from the surface potential on the photosensitive member, but the present invention is by no means limited to such structure. As an example, the original density may be directly detected with an optical sensor. Also the original density may be obtained by averaging or by integration.

As explained in the foregoing, the copying apparatus of the present invention displays, in the automatic density control mode, the amount of exposure determined by the density measurement of the original document in a manner corresponding to the density control lever for use in the manual density control mode, whereby the operator can make an adjustment around the thus displayed density. In this manner it is therefore rendered possible to realize automatic density control with excellent manual adjustability.

What is claimed is:

1. A copying apparatus comprising:

image forming means for forming a copy image of an original on a recording member;

setting means for manually setting the copy density of the image to be formed by said image forming means;

detecting means for detecting the density of said original;

selecting means for selecting either a first mode in which said copy density is set by said setting means without regard to the density of the original or a second mode in which said copy density is set in response to an output of said detecting means; and adjusting means for permitting said setting means to adjust said copy density, which has been set in response to the output of said detecting means when the second mode is selected, within a predetermined range without releasing the second mode.

2. A copying apparatus according to claim 1, wherein said adjusting means is adapted to enable adjustment of the copy density within a determined range which is defined around the copy density set in response to the output of said detecting means.

3. A copying apparatus according to claim 1, further comprising display means for displaying said copy density in said first and second modes.

4. A copying apparatus according to claim 1 or 2, wherein said detecting means is adapted to detect the density of the original from the surfacial state of said recording member.

5. A copying apparatus according to claim 4, wherein said surfacial state is the surface potential.

6. A copying apparatus according to claim 1, wherein said image forming means comprises exposure means for exposing the original and is adapted to control said exposure means in response to said copy density.

7. A copying apparatus comprising:

image forming means for forming an image of an original on a recording member;

setting means for manually setting the copy density of the image to be formed by said image forming means, wherein said setting means comprises first operating means for decreasing stepwise the set value, and second operating means for increasing stepwise the set value;

detecting means for detecting the density of said original;

selecting means for selecting either a first mode in which said copy density is set by said setting means without regard to the density of the original or a second mode in which said copy density is set in response to the detection of the density of said original;

adjusting means for permitting said setting means to adjust the copy density, which has been set in response to an output of said detecting means when the second mode is selected; and display means for displaying the copy density set in said first and second modes, said display means being adapted to display the copy density set in the second mode corresponding to the level of the copy density adjusted in accordance with operation of said adjusting means.

8. A copying apparatus according to claim 7, wherein said display means comprises plural light-emitting elements.

9. A copying apparatus comprising:

image forming means for forming a copy image of an original on a recording member;

setting means for manually setting the copy density of the image to be formed by said image forming means;

detecting means for detecting the density of said original;

selecting means for selecting either a first mode in which said copy density is set by said setting means without regard to the density of the original or a second mode in which said copy density is set in response to an output of said detecting means; and adjusting means for permitting said setting means to adjust the copy density, which has been set in response to the output of said detecting means when the second mode is selected, within a predetermined range centered on said copy density set in the second mode.

10. A copying apparatus according to claim 9, wherein said adjusting means is adapted to enable adjustment of the copy density without releasing the second mode.

* * * * *